US008002343B2

(12) United States Patent
Song et al.

(10) Patent No.: US 8,002,343 B2
(45) Date of Patent: Aug. 23, 2011

(54) FOLDABLE DINING CHAIR FOR CHILDREN

(75) Inventors: Zhenghuan Song, Kunshan (CN); Feng Liu, Kunshan (CN)

(73) Assignee: Goodbaby Child Products Co., Ltd., Kunshan, Jiangsu Province (CN)

( * ) Notice: Subject to any disclaimer, the term of this patent is extended or adjusted under 35 U.S.C. 154(b) by 109 days.

(21) Appl. No.: 12/307,040

(22) PCT Filed: Aug. 14, 2006

(86) PCT No.: PCT/CN2006/002056

§ 371 (c)(1),
(2), (4) Date: May 18, 2009

(87) PCT Pub. No.: WO2008/006255

PCT Pub. Date: Jan. 17, 2008

(65) Prior Publication Data

US 2010/0013272 A1 Jan. 21, 2010

(30) Foreign Application Priority Data

Jul. 4, 2006 (CN) ..... 2006 1 0086315

(51) Int. Cl.
*A47D 1/02* (2006.01)

(52) U.S. Cl. ..... 297/16.1; 297/47; 297/48

(58) Field of Classification Search ..... 297/16.1, 297/46, 48, 49

See application file for complete search history.

(56) References Cited

U.S. PATENT DOCUMENTS 2,793,681 A * 5/1957 Delon et al. ..... 297/46
3,425,743 A * 2/1969 Peterson ..... 297/19
4,008,918 A * 2/1977 Cooper et al. ..... 297/16.1

(Continued)

FOREIGN PATENT DOCUMENTS

CN 2544617 Y 4/2003

(Continued)

OTHER PUBLICATIONS

International Search Report for PCT/CN2006/002056.

*Primary Examiner* — Peter R. Brown

(74) *Attorney, Agent, or Firm* — Stephen C. Beuerle; Procopio Cory Hargreaves & Savitch LLP

(57) ABSTRACT

A foldable dining chair for children comprises a frame body (1) and a seat mechanism disposed thereon. The frame body (1) may be in an open state and a folded state. The frame body (1) is folded in back-and-forth direction and up-and-down direction thereof when it is in the folded state. The frame body (1) comprises a backrest frame (2), an armrest frame (3) of which the rear end is rotatably connected to the backrest frame (2), an upright support frame (4) of which the upper end is rotatably connected to the front end of the armrest frame (3), a seat frame (5) of which the front end is rotatably connected to the upright support frame (4), a front support frame (6) rotatably connected to the lower end of the upright support frame (4), and a rear support frame (7). The rear end of the seat frame (5) is connected rotatably to the rear support frame (7). One of the lower end of the backrest frame (2), the upper end of the front support frame (6) and the upper end of the rear support frame (7) is connected rotatably to the other two thereof.

10 Claims, 5 Drawing Sheets

U.S. PATENT DOCUMENTS

| | | | | |
|---|---|---|---|---|
| 4,556,249 | A * | 12/1985 | Kassai | 297/30 |
| 5,087,066 | A * | 2/1992 | Mong-Hsing | 280/644 |
| 5,622,376 | A * | 4/1997 | Shamie | 280/642 |
| 2003/0020303 | A1 | 1/2003 | Chen | |
| 2007/0029845 | A1 * | 2/2007 | Riedl et al. | 297/16.1 |

FOREIGN PATENT DOCUMENTS

| | | |
|---|---|---|
| CN | 1615773 A | 5/2005 |
| CN | 1652710 A | 8/2005 |

* cited by examiner

FOLDABLE DINING CHAIR FOR CHILDREN

TECHNICAL FIELD

The present invention relates to a foldable dining chair for children.

BACKGROUND TECHNOLOGY

In the prior art, a foldable dining chair for children includes a frame body which can be controlled in an open state and a folded state, and a seat mechanism disposed thereon. The described frame body is folded in back-and-forth direction and up-and-down direction thereof when it is in the folded state. The current foldable dining chairs for children commonly can be classified into two kinds that one has a simple structure while a larger size after being folded; and the other has a smaller size in its folded state, but has a more complex structure making folding process complicated.

SUMMARY OF THE INVENTION

The present invention is to provide a foldable dining chair for children, which has a simple structure, can be folded under an easy method and has a smaller size after being folded.

The present invention provides a foldable dining chair for children comprising a frame body and a seat mechanism disposed thereon. The frame body is controlled in an open state and a folded state. The frame body is folded in back-and-forth direction and up-and-down direction thereof when being transferred into its folded state. The frame body comprises a backrest frame, an armrest frame of which the rear end is rotatably connected to the backrest frame, an upright support frame of which the upper end is rotatably connected to the front end of the armrest frame, a seat frame of which the front end is rotatably connected to the upright support frame, a front support frame rotatably connected to the lower end of the upright support frame, and a rear support frame. The rear end of the seat frame is connected rotatably to the rear support frame. One of the lower end of the backrest frame, the upper end of the front support frame and the upper end of the rear support frame is connected rotatably to the other two thereof.

Preferably, the lower end of the backrest frame, the upper end of the front support frame and the upper end of the rear support frame is rotatably connected by a same axis.

More specifically, the lower end of the backrest frame is rotatably connected to the upper end of the front support frame via a first shaft, and the upper end of the rear support frame is rotatably connected to the upper end of the front support frame via a second shaft.

When the frame body is in its open state, the joint of the upper end of the front support frame and the upper end of the rear support frame is in front upward side of the joint of the rear end of the seat frame and the rear support frame.

When the frame body is in its open state, both the joint of the lower end of the backrest frame and the upper end of the front support frame, and the joint of the upper end of the rear support frame and the upper end of the front support frame are situated in rear upward side of the joint of the lower end of the upright support frame and the front support frame.

When the frame body is in its open state, the joint of the rear end of the armrest frame and the backrest frame is in upward side of joint of the lower end of the backrest frame and the upper end of the front support frame.

Furthermore, a block is set in the upper end of the rear support frame, and when the frame body is in its open state, the block supports on the backrest frame, to make the rear support frame be opened stably opposite to the front support frame.

Preferably, an opening-and-locking mechanism is mounted on the frame body.

More specifically, the opening-and-locking mechanism is set between the backrest frame and the front support frame.

When the frame body of the dining chair is in its open state, the joint of the upright support frame and the front end of the seat frame is in upward side of the joint of the lower end of the upright support frame and the front support frame.

The front end of the armrest frame is rotatably connected to the upper end of a connecting member, and the lower end of the connecting member is rotatably connected to the upper end of the upright support frame.

Comparing to the prior technology, this invention has following advantages that:

Due to the frame body has fewer pole frames and forms a set of linkage mechanism thereof, accordingly, it has a simpler structure, is more convenient to fold and has a smaller size after being folded.

Thereinto: 1. frame body; 2. backrest frame; 3. armrest frame; 4. upright support frame; 5. seat frame; 6. front support frame; 7. rear support frame; 8. unlocking operating part; 9. connecting member; 10. footrest frame; 11. block; 12. locking spring pin; 13. locking hole; 14. first shaft; 15. second shaft.

DETAILED DESCRIPTION OF THE INVENTION

Figure 1:
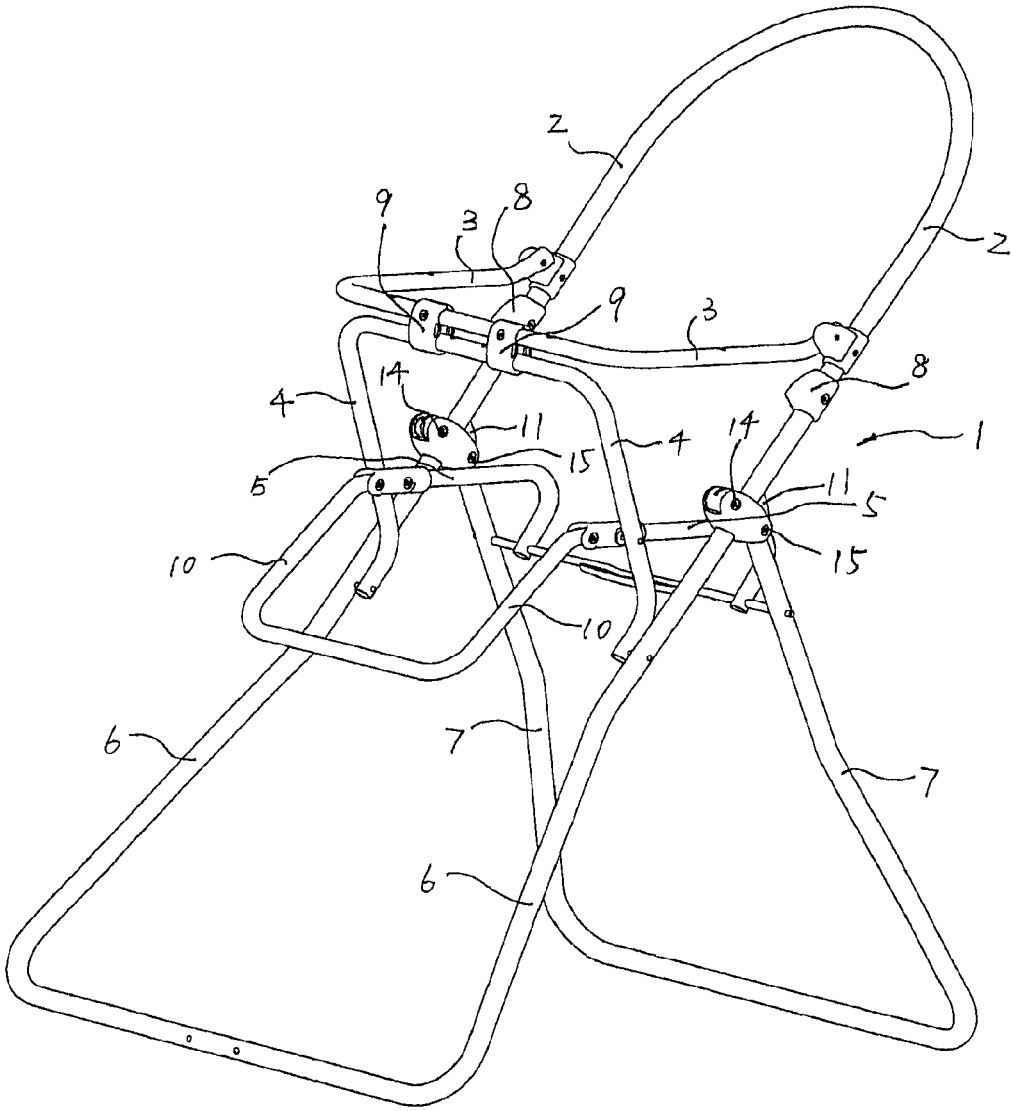
FIG. 1 is a perspective view of the frame body in open state.
Figure 2:
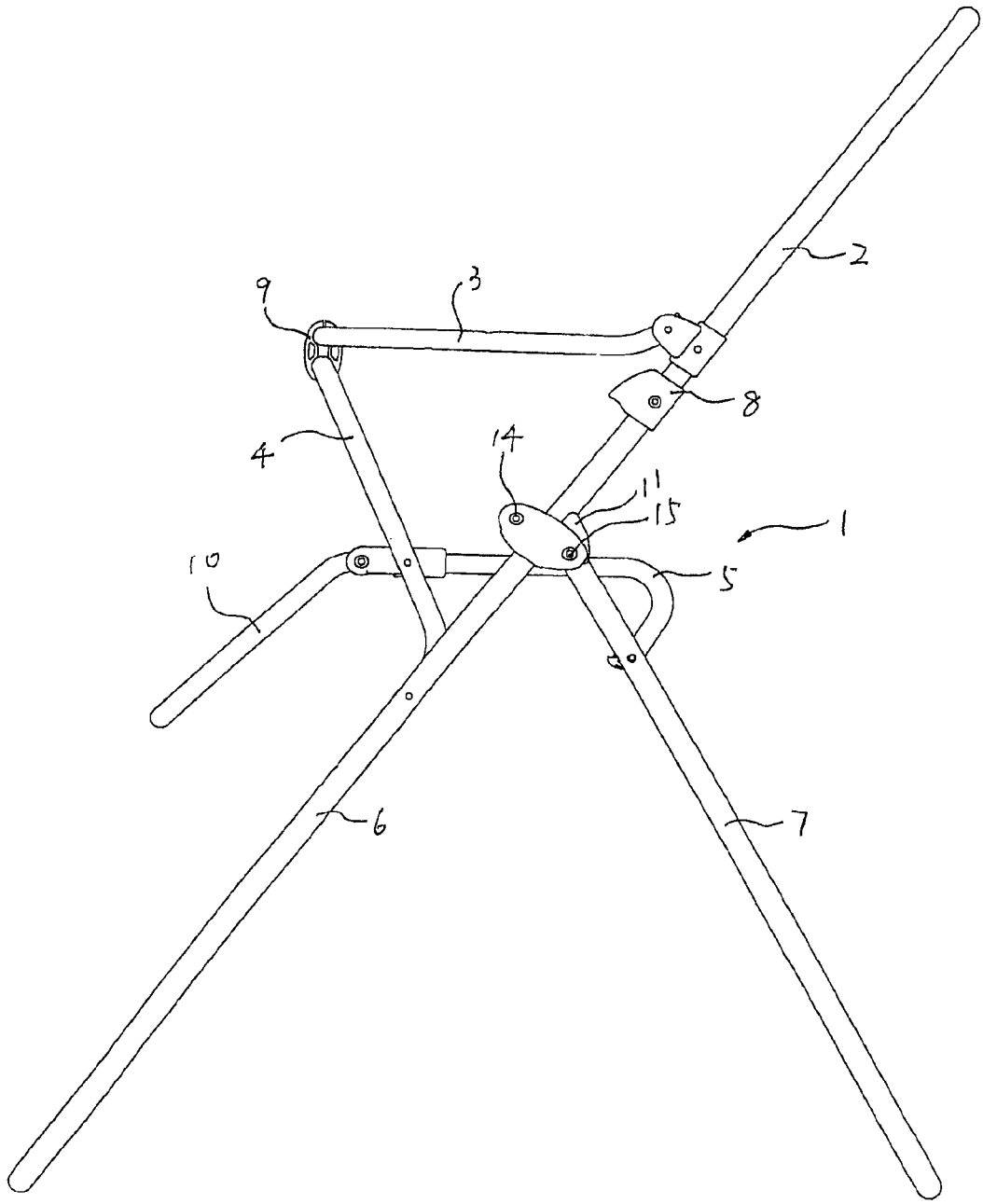
FIG. 2 is a schematic diagram of the frame body in open state.
Figure 3:
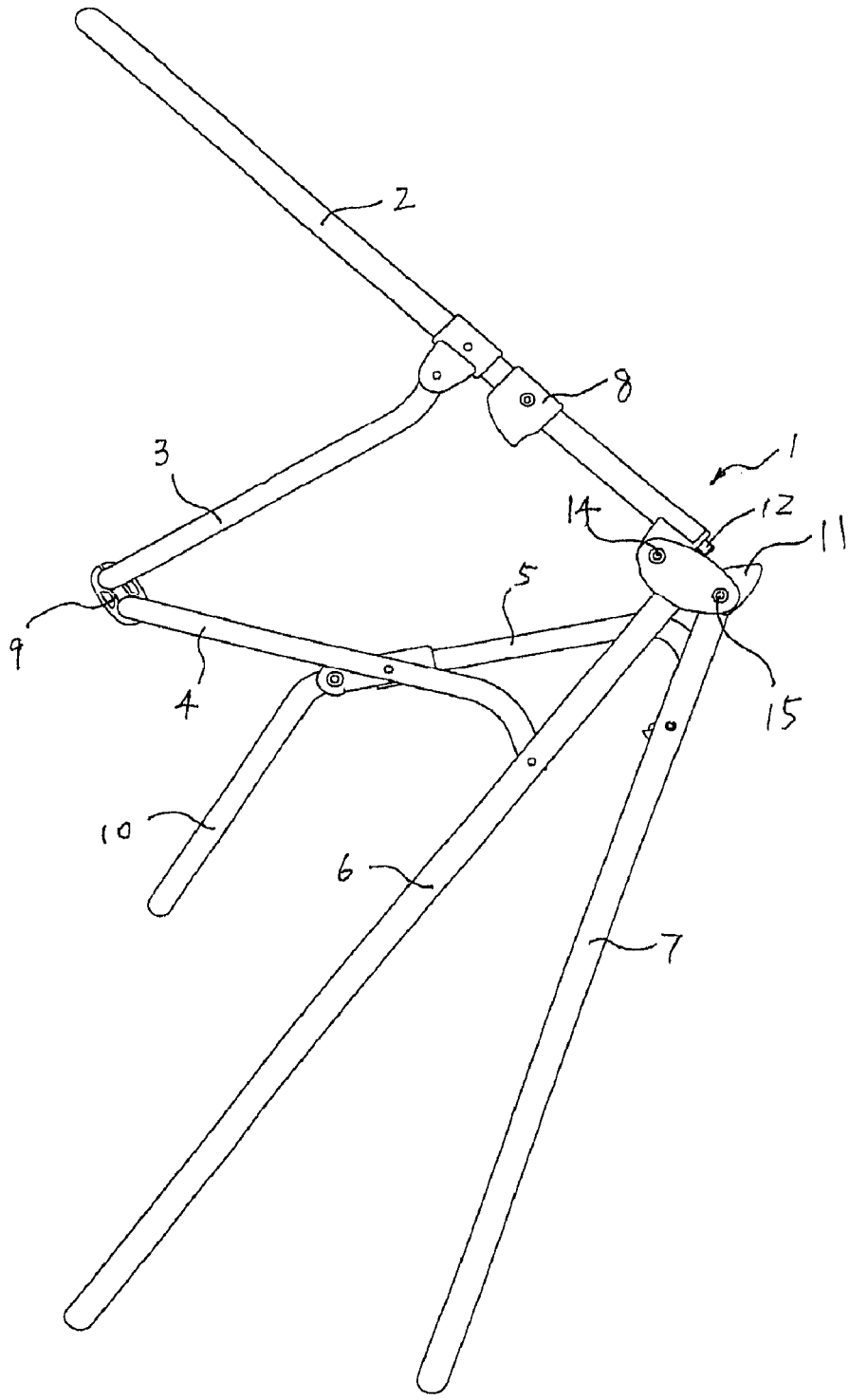
FIG. 3 is a schematic diagram of the frame body in half-lap state.
Figure 4:
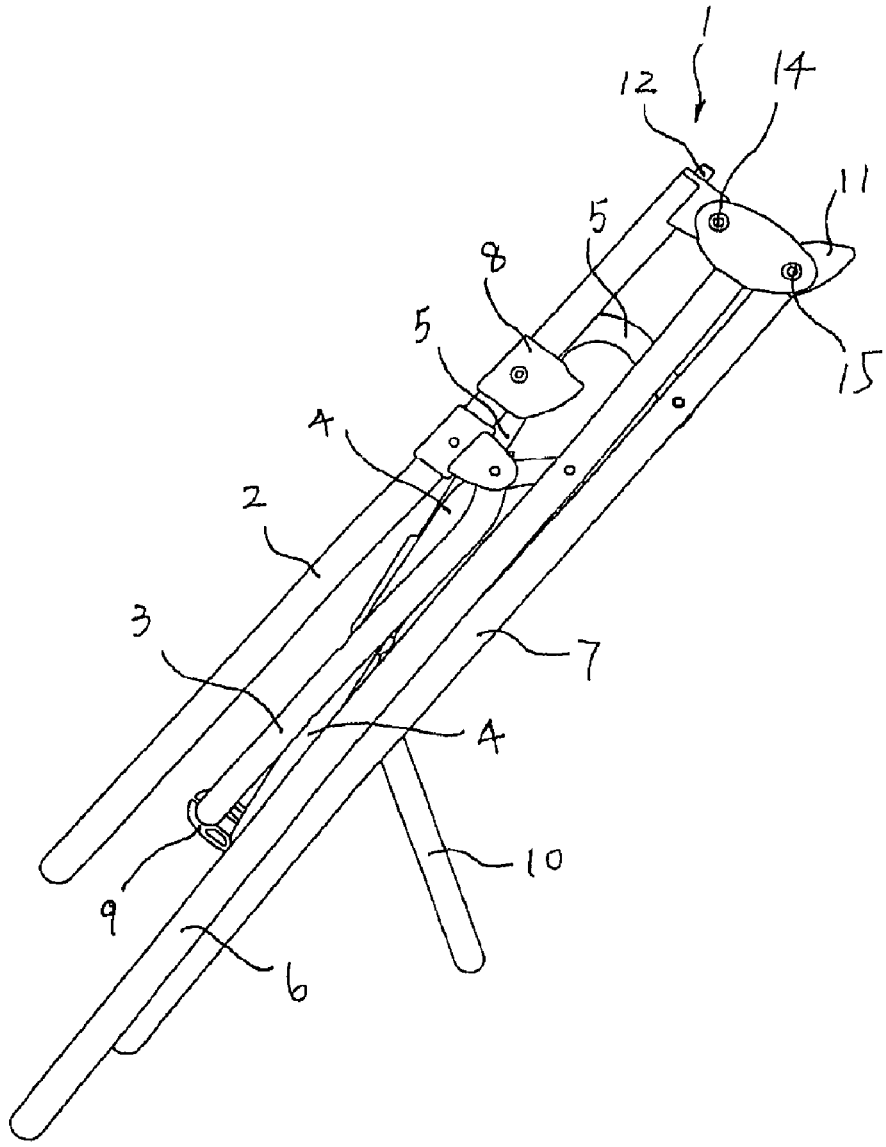
FIG. 4 is a schematic diagram of the frame body in folded state.
Figure 5:
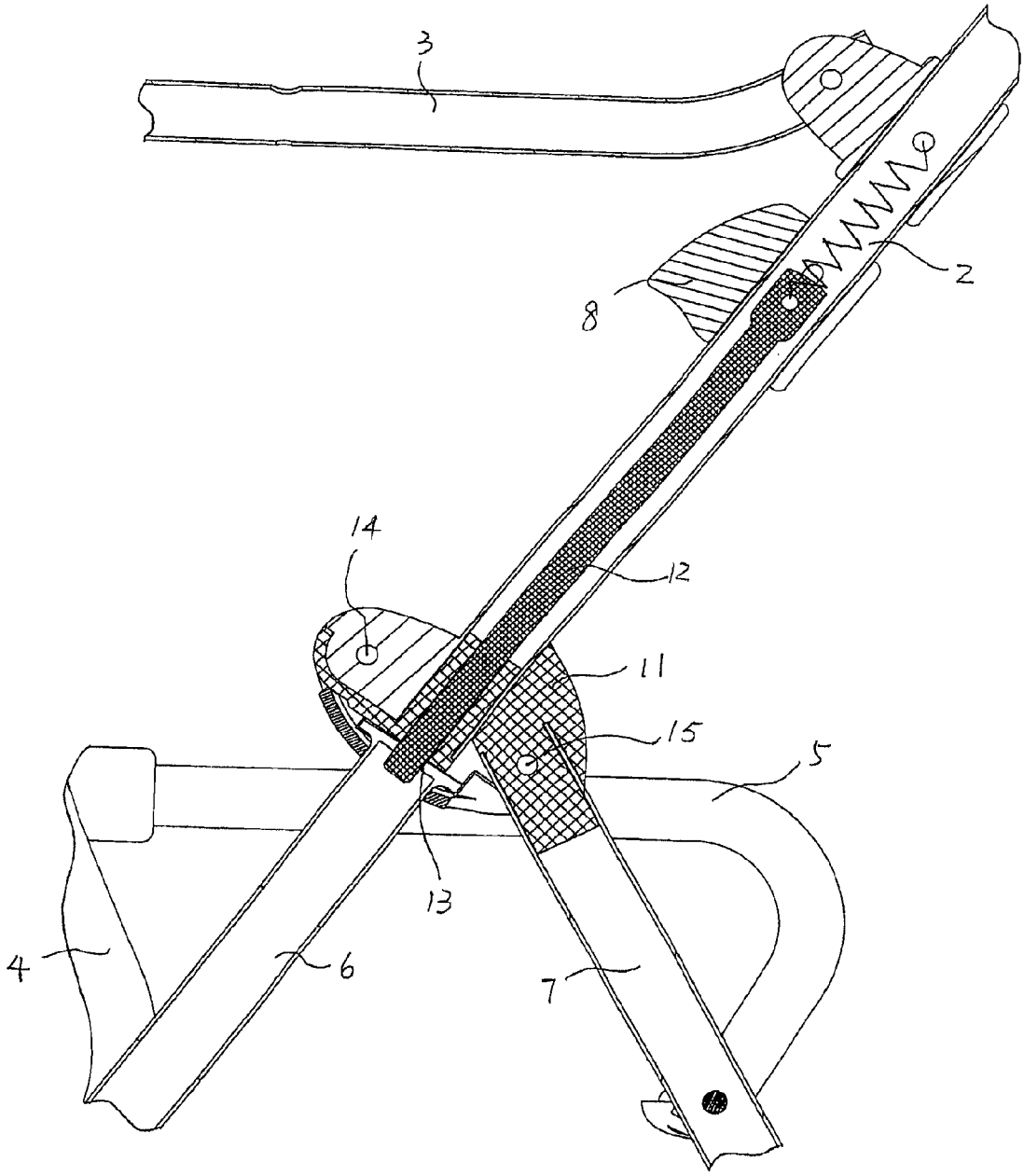
FIG. 5 is a section view of the opening-and-locking mechanism.

As shown in FIGS. 1 and 4, the foldable dining chair for children according to the invention comprises a frame body 1 and a seat mechanism disposed thereon. The frame body 1 is controlled to be in an open state and a folded state. The frame body 1 is folded in back and forth direction and up and down direction thereof when it 1 is in the folded state. The frame body 1 includes a backrest frame 2, an armrest frame 3 of which the rear end is rotatably connected to the backrest frame 2, an upright support frame 4 of which the upper end is rotatably connected to the front end of the armrest frame 3, a seat frame 5 of which the front end is rotatably connected to the upright support frame 4, a front support frame 6 rotatably connected to the lower end of the upright support frame 4, and a rear support frame 7. The rear end of the seat frame 5 is connected rotatably to the rear support frame 7. One of the lower end of the backrest frame 2, the upper end of the front support frame 6 and the upper end of the rear support frame 7 is connected rotatably to the other two thereof.

There are varieties of connection modes among the lower end of the backrest frame 2, the upper end of the front support frame 6 and the upper end of the rear support frame 7.

First: no drawing, the lower end of the backrest frame 2, the upper end of the front support frame 6 and the upper end of the rear support frame 7 are connected rotatably in a same axis.

Second: as shown in each drawing, the lower end of the backrest frame 2 is rotatably connected to the upper end of the front support frame 6 via the first shaft 14, and the upper end of the rear support frame 7 is rotatably connected to the upper end of the front support frame 6 via the second shaft 15.

Third: no drawing, the lower end of the backrest frame 2 is rotatably connected to the upper end of the rear support frame 7 via one rotation axis, and the upper end of the front support frame 6 is rotatably connected to the upper end of the rear support frame 7 via the other rotation axis.

Fourth: no drawing, the upper end of the rear support frame 7 is rotatably connected to the lower end of the backrest frame 2 via one rotation axis, and the upper end of the front support frame 6 is rotatably connected to the lower end of the backrest frame 2 via the other rotation axis.

This operation example adopts the second mode for connection of the lower end of the backrest frame 2, the upper end of the front support frame 6 and the upper end of the rear support frame 7. A block 11 is set in the upper end of the rear support frame 7, and when the frame body 1 is in an open state, the block 11 will support on the backrest frame 2, and this block 11 is used to make the rear support frame 7 stably open as opposed to the front support frame 6.

When the frame body 1 is in an open state, the rotating joint of the upper end of the front support frame 6 and the upper end of the rear support frame 7 is in front upward side of the rotating joint of the rear end of the seat frame 5 and the rear support frame 7. When the frame body 1 is in an open state, the rotating joints of the lower end of the backrest frame 2 and the upper end of the front support frame 6, the upper end of the rear support frame 7 and the upper end of the front support frame 6 both place in rear upward side of the rotating joint of the lower end of the upright support frame 4 and the front support frame 6. When the frame body 1 is in an open state, the rotating joint of the rear end of the armrest frame 3 and the backrest frame 2 is in the upward side of the rotating joint of the lower end of the backrest frame 2 and the upper end of the front support frame 6. When the frame body 1 is in an open state, the rotating joint of the upright support frame 4 and the front end of the seat frame 5 is in the upward side of the rotating joint of the lower end of the upright support frame 4 and the front support frame 6.

An opening and locking mechanism is set on the frame body 1. This opening and locking mechanism may be set between the backrest frame 2 and the armrest frame 3; between the backrest frame 2 and the rear support frame 7; between the upright support frame 4 and the seat frame 5; between the upright support frame 4 and the front support frame 6; between the seat frame 5 and the rear support frame 7; and between the front support frame 6 and the rear support frame 7. The opening and locking mechanism set in this operation example is set between the backrest frame 2 and the front support frame 6. There are also varieties of opening and locking mechanism described, for example, a locking hook may be rotatably set in the front support frame 6, and a locking groove set in the backrest frame 2. When the frame body 1 is in an open state, the locking hook may hook on to the locking groove, and separate from this groove when the frame body is in a folded state; as shown in Drawing 5, the operation example adopts slidably setting a locking spring pin 12 on the backrest frame 2, and a locking hole 13 in the front support frame 6, when the frame body 1 is in an open state, the locking spring pin 12 inserts into the locking hole 13, and when the frame body 1 is in an folded state, the locking spring pin 12 may separate from the locking hole 13.

The front end of the armrest frame 3 and the upper end of the upright support frame 4 are rotatably set, and the front end of the armrest frame 3 may be rotatably connected to the upper end of the upright support frame 4 via a third part, as shown in Drawing 1 and Drawing 4, the front end of the armrest frame 3 may rotatably connect to the upper end having a connecting member 9, and the lower end of the connecting member 9 is rotatably connected to the upper end of the upright support frame 4; the front end of the armrest frame 3 also may directly and rotatably connect to the upper end of the upright support frame 4. The front end of the seat frame 5 may rotatably connect to the rear end having a footrest frame 10.

The upper end, lower end, front end and rear end for the invention are to be referred under the condition that the frame body 1 is in an open state.

The invention claimed is:

1. A foldable dining chair for children comprises, a frame body, said frame body being controlled to be in an open state and a folded state, wherein the frame body is folded in back-and-forth direction and up-and-down direction thereof when being transferred into its folded state; and a seat mechanism disposed on the frame body;

wherein the frame body comprises, a backrest frame including an upper end and a lower end;

an armrest frame including a rear end and a front end, the rear end of which is rotatably connected to the backrest frame;

an upright support frame including an upper end and a lower end, the upper end of which is rotatably connected to the front end of the armrest frame;

a seat frame including a front end and a rear end, the front end of which is rotatably connected to the upright support frame;

a front support frame including an upper end and a lower end, rotatably connected to the lower end of the upright support frame (4); and a rear support frame including an upper end and a lower end, rotatably connected to the rear end of the seat frame, wherein one of the lower end of the backrest frame, the upper end of the front support frame and the upper end of the rear support frame is rotatably coupled to two of the lower end of the backrest frame, the upper end of the front support frame and the upper end of the rear support frame.

2. The foldable dining chair for children according to claim 1, wherein the lower end of the backrest frame is rotatably connected to the upper end of the front frame via a first shaft and the upper end of the rear support frame is rotatably connected to the upper end of the front support frame via a second shaft, the first shaft and the second shaft being spaced from each other.

3. The foldable dining chair for children according to claim 2, wherein when the frame body is in unfolded state, the joint where the upper end of the front support frame is rotatably connected to the upper end of the rear support frame is situated above the front of the position in which the rear end of the seat frame is rotatably connected to the rear support frame.

4. The foldable dining chair for children according to claim 2, wherein when the frame body is in open state, the position in which the lower end of the backrest frame is rotatably connected to the upper end of front support frame, and the position in which the upper end of the rear support frame is rotatably connected to the upper end of the front support frame are both placed above the back of the point at which where the lower end of the upright support frame and the front support frame are rotatably connected.

5. The foldable dining chair for children according to claim 2, wherein when the frame body is in open state, the place where the rear end of the armrest frame is rotatably connected to the backrest frame is above the place in which the lower end of the backrest frame is rotatably connected to the upper end of the front support frame.

6. The foldable dining chair for children according to claim 2, wherein a block is placed on the rear support frame, being directly supported on the backrest frame when the frame body is in unfolded state, the block being used to steadily unfold the rear support frame away from the front support frame.

7. The foldable dining chair for children according to claim 1, wherein an opening-and-locking mechanism is mounted on the frame body to enable opening of the foldable dining chair and locking of the foldable dining chair in an open state.

8. The foldable dining chair for children according to claim 7, wherein an opening-and-locking mechanism operably coupling the backrest frame and the front support frame.

9. The foldable dining chair for children according to claim 1, wherein when the frame body is in open state, the place where the upright support frame is rotatably connected to the front end of the seat frame is above the place where the lower end of the upright support frame is rotatably connected to the front support frame.

10. The foldable dining chair for children according to claim 1, wherein the armrest frame has a front end which is rotatably connected to the upper end of the connecting members, and the upright support frame has a lower end which is rotatably connected to the lower end of the connecting members.

* * * * *